US009468929B2

(12) United States Patent
Lefas et al.

(10) Patent No.: US 9,468,929 B2
(45) Date of Patent: Oct. 18, 2016

(54) STATIONARY DISC, ROTATING DISC AND MILL ASSEMBLY FOR REDUCING MACHINES

(71) Applicants: Hristos Lefas, Toronto (CA); Friedhelm Roderich Feder, Colmesneil, TX (US)

(72) Inventors: Hristos Lefas, Toronto (CA); Friedhelm Roderich Feder, Colmesneil, TX (US)

(73) Assignee: Orenda Automation Technologies Inc. (CA)

( * ) Notice: Subject to any disclaimer, the term of this patent is extended or adjusted under 35 U.S.C. 154(b) by 721 days.

(21) Appl. No.: 13/742,773

(22) Filed: Jan. 16, 2013

(65) Prior Publication Data

US 2014/0197259 A1 Jul. 17, 2014

(51) Int. Cl.
*B02C 7/17* (2006.01)
*B02C 7/08* (2006.01)

(52) U.S. Cl.
CPC .. *B02C 7/17* (2013.01); *B02C 7/08* (2013.01)

(58) Field of Classification Search
CPC ..... B02C 7/17; B02C 7/08
USPC ..... 241/261.2, 261.3, 296–298
See application file for complete search history.

(56) References Cited

U.S. PATENT DOCUMENTS

| | | | | |
|---|---|---|---|---|
| 4,081,147 | A * | 3/1978 | Seifert et al. | D21D 1/30 241/261.3 |
| 5,941,467 | A | 8/1999 | McArdle et al. | 241/5 |
| 8,282,031 | B2 | 10/2012 | Sly et al. | 241/261 |
| 2004/0155127 | A1* | 8/2004 | Kapper | B02C 7/04 241/30 |
| 2006/0086856 | A1* | 4/2006 | Pallmann | B02C 7/17 241/261.2 |
| 2011/0318440 | A1 | 12/2011 | Zollitsch et al. | 425/67 |

FOREIGN PATENT DOCUMENTS

| | | | | |
|---|---|---|---|---|
| EP | 1 028 808 | B1 | 11/2006 | B02C 1/100 |
| EP | 2 399 716 | A2 | 12/2011 | B29B 9/06 |
| WO | WO 99/12647 | A2 | 3/1999 | |
| WO | WO 2011/106115 | A2 | 9/2011 | B02C 7/02 |

* cited by examiner

*Primary Examiner* — Mark Rosenbaum
(74) *Attorney, Agent, or Firm* — Mark A. Garzia, Esq.; Law Offices of Mark A. Garzia, P.C.

(57) ABSTRACT

A reducing machine having an air cooled cutting discs is disclosed. The air cooled discs have cutting surfaces on both sides. The cutting surfaces have edges which are sharpened for cutting input material when the cutting surface is facing the cutting surface of the opposed disc. When the cutting surface of the stationary disc is facing the housing, the cutting surface acts as a heat sink to air cool the stationary disc and the mill assembly in general. Air inlets in the housing lid permit air to flow over the cooling surface. A damper restricts air flow over the air cooling surface to control the temperature of the reducing machine, such as during start up.

10 Claims, 12 Drawing Sheets

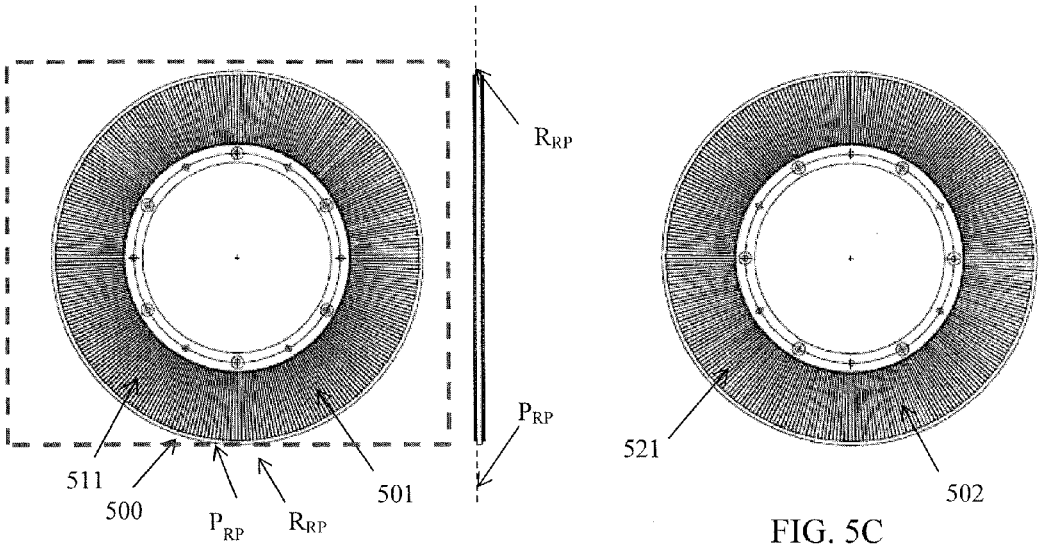
FIG. 5A
FIG. 5B
FIG. 5C
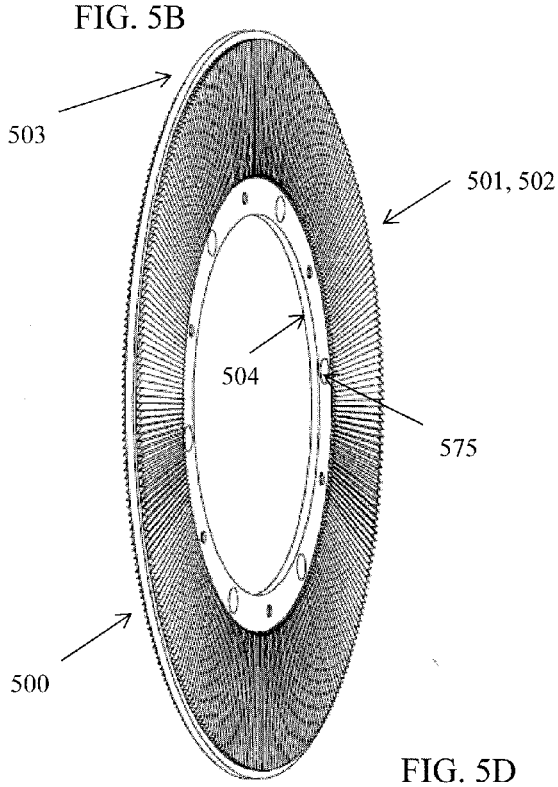
FIG. 5D

STATIONARY DISC, ROTATING DISC AND MILL ASSEMBLY FOR REDUCING MACHINES

FIELD OF THE INVENTION

The invention relates to the field of reducing machines and in particular pulverizing machines. More particularly, the present invention relates to stationary discs, rotating discs and disc mill assemblies for use in such machines.

BACKGROUND OF THE INVENTION

In the past, reducing machines, including pulverizing systems, have used disc mill assemblies to grind, shred or pulverize various types of materials such as plastics, nylons, polyesters and other polymers into powder, amongst other industrial applications. Typically, reducing machines have cooperating cutting discs having opposed cutting surfaces. Typically, one cutting disc is stationary, often referred to as the stationary disc, and one cutting disc is rotating, often referred to as the rotating disc. Input material to be reduced passes between the cutting surfaces of the discs radially from the centre to the circumference by virtue of centrifugal force, often assisted by a vacuum created by a fan forming a part of the reducing machine.

A major problem with reducing machines in general is the management of heat. As the input material is ground, shredded or pulverized by the relative rotation of the cutting discs, heat is generated and must be dissipated to avoid damage to the discs as well as potentially melting or degrading of the input materials. To facilitate cooling of the disc assembly, prior art reducing machines have generally utilized a water cooling system, including a water jacket assembly, for cooling the stationary disc as disclosed for instance in U.S. Pat. No. 8,282,031 B2 to Sly. The water jacket cooling assembly would permit water, or another liquid, to be circulated on the non-cutting surface of the stationary reducing disc to dissipate heat generated by the cutting surfaces of the disc assembly, and in particular the stationary disc when it is in facing operative relation the rotating disc arranged.

However, water jacket assemblies can be rather expensive to design, build and maintain, thereby increasing the cost of the overall machine. Also, water jackets leak regularly thereby causing rusting of the disc assembly, and/or contaminate the input material being reduced.

A further difficulty with water cooling of the stationary disc is that, invariably, the temperature of the stationary disc near the water inlet will be lower than the temperature of the stationary disc at a location remote from the water inlet due to the fact that the water will absorb heat while it is circulating and in thermal contact with the stationary disc. This can cause temperature variations and thermal imbalances in the stationary disc which can cause structural stress.

Furthermore, if the operators of the reducing machines are not careful and turn on the water cooling system when the stationary disc has been operating for some time and is at an elevated temperature, the stationary disc could experience "thermal shock" from a sudden temperature decrease. This often results in damage to the stationary disc and, in some cases, a catastrophic failure of the stationary disc.

Furthermore, because of the risk of "thermal shock" and other damage that could be caused by water cooling, the material used for the cutting discs, and in particular the stationary disc, would need to be selected such as to decrease the possibility of such "thermal shock" for safety purposes. In particular, the material of the stationary disc would need to be of a softer material to decrease the possibility of cracking.

A further disadvantage of the prior reducing machines is that considerable time is required in which to initially heat up the reducing machine prior to use. Typically, the reduced material generated while the reducing machine is warming up, is often called "off-spec" or "off specification" reduced material, and is usually discarded or blended back with the input material for further processing. At present, many prior art reducing machines are run with material for about 20 to 30 minutes in order to heat the reducing machine prior to producing useful reduced material. During the initial heating process, raw material is inserted into the machine and then the resulting off-spec material is discarded. Throughout the initial heating process, the stationary disc must be continuously cooled using the water cooling system, otherwise thermal shock could arise if the water cooling is suddenly commenced after the reducing machine, including the stationary disc, has been heated to an operating temperature. Because of this, the water cooling acts against the initial heating of the reducing machine thereby lengthening the amount of time required in order to heat the reducing machine to a useable temperature and generating additional off-spec material that is generally discarded or blended back with the input material. This also increases the wear and tear of the mill assembly as a whole because it must be operated for a longer period of time to heat the reducing machine.

Accordingly, the prior art reducing machines suffer from several disadvantages related to the manner in which the mill assembly, and in particular the stationary disc, is cooled. Furthermore, the method of cooling of the mill assembly, and in particular the stationary disc according to the prior art assembly, increases the cost of manufacture assembly and operation and also restricts the nature of the material used for the discs.

SUMMARY OF THE INVENTION

Accordingly, it is an object of this invention to at least partially overcome some of the disadvantages of the prior art. In particular, an object of the invention to provide an improved type of stationary disc in mill assembly for a reducing machine, and in particular a pulverizing machine, which eliminates the need for water cooling and the attendant limitation of water cooled pulverisers.

Accordingly, in one of its aspects, this invention resides in a disc mill assembly of a reducing apparatus having a fan, said disc mill assembly comprising: a rotating disc having a rotating cutting surface; a stationary disc having a stationary cutting surface on a first side for operative interaction with the rotating cutting surface of the opposed rotating disc, and, a second side having an air cooling surface in thermal contact with the stationary cutting surface; a housing lid having air inlets on an external wall; an attaching mechanism for operatively attaching the stationary disc to the housing lid with the air cooling surface facing the air inlets and axially separated therefrom to permit air flow between said housing and the cooling surface; wherein, during operation, the fan draws air from the air inlets, between the housing and the air cooling surface to cool the stationary disc.

In a further aspect, the present invention resides in a stationary disc for use in a disc mill assembly of a reducing machine, said stationary disc comprising: a first side having a stationary cutting surface for operative interaction with a rotating cutting surface of an opposed rotating disc; a second side having an air cooling surface in thermal contact with the stationary cutting surface; an attaching mechanism for operatively attaching the stationary disc to a housing, said housing having air inlets through an external wall, with the air cooling surface facing the air inlets and axially separated therefrom to permit air to flow between said housing and said cooling surface, and, with said stationary cutting surface arranged in facing operative interaction with the rotating cutting surface of the opposed rotating disc to reduce the input material; wherein, during operation, air is drawn in through the air inlets of the housing and across the air cooling surface to cool the stationary disc.

In a still further aspect, the present invention provides a rotary disc for use in a disc mill assembly of a reducing machine, said rotating disc comprising: a first rotating cutting surface for operative interaction with cutting surfaces of an opposed stationary disc; a second rotating cutting surface for operative interaction with cutting surfaces of the opposed stationary disc; wherein the rotating disc is substantially symmetrical about a central radial plane with said second rotating cutting surface substantially opposite to the first rotating cutting surface about the central radial plane; wherein the rotating disc is fixed to a rotating shaft in a first orientation with respect to the stationary disc with the first rotating cutting surface facing the stationary disc to reduce input material, and after the rotating cutting surface is no longer functional for reducing input material, the rotating disc is fixed to the rotating shaft in a second orientation with respect to the stationary disc with the second rotating cutting surface facing the stationary disc to reduce input material.

Accordingly, one advantage of the present invention is that the stationary disc is air cooled rather than water cooled. In this way, the risk of thermal shock is eliminated as air cooling is a less aggressive form of cooling than water cooling. Also, air cooling according to the present invention utilizes the vacuum created by a fan, or the fan of the reducing machine itself such that it is inherently active at all times that the machine is active. In this way, sudden temperature differences are avoided because air cooling is active whenever the fan is active. Furthermore, air cooling provides more uniform heat transfer rates over time and also over the surface of the stationary disc.

Furthermore, air cooling involves fewer component parts and, in particular, separate chilling and pumping units common with water cooling are not required. Rather, in a preferred embodiment, the vacuum generated by the fan of the reducing machine is used to cause airflow across the cooling surface of the stationary disc, thereby decreasing the costs of the overall machine and also the operation. Furthermore, because there is no water jacket and no corresponding connections to the water jacket that must be removed when the stationary disc is replaced, the replacement of this stationary disc becomes easier and less time consuming.

A further advantage of the present invention is that because thermal shock is of lessened concern, the material used for the discs in the mill assembly, and in particular the stationary disc, can be changed to improve performance and durability as safety concerns due to cracking are lessened. In particular, a harder material can be used, particularly for the stationary disc.

A further advantage of the present invention is that the stationary disc no longer needs to have a flat surface in contact with the water jacket for cooling. Rather, it is preferable if the cooling surface is ribbed or has fins to promote air cooling. Because of this, the shape of the side of the disc which is not operatively facing the rotating disc can be changed and need not be flat. In one preferred embodiment, the cooling surface comprises a plurality of radial ridges which are also sharpened and can act as a second cutting surface when the first cutting surface becomes dull. In this way, the stationary disc can have two operational cutting surfaces for use at different times. In this way, the ridges of the cutting surfaces can perform the dual purpose of acting as a heat sink, when they are facing the air inlets for the housing and not facing the cutting surface of the rotating disc, and, can act as a cutting surface when facing the cutting surface of the rotating disc.

A further advantage of the present invention is that the rotating disc can also be made to have rotating surfaces on either side similar to the preferred embodiment of the stationary disc. In this way, the rotating disc and the stationary disc can effectively double the service life of the discs used in the disc mill assembly as compared to discs having cutting surfaces on only a single side of the stationary disc and rotating disc.

In a further preferred embodiment, the stationary disc and rotating disc are designed not to be resharpened. In this way, once the rotating disc and the stationary disc are used until the cutting surfaces on both sides are dull, they can be discarded. In this way, lighter material can be used for the stationary disc and rotating disc which also facilitates cooling of the stationary disc and rotating disc. Furthermore, using a lighter material decreases transportation costs and manufacturing cost of both the stationary disc and rotating disc. By effectively doubling the service life of each disc, there are financial and logistical benefits which arise from one disc being shipped and purchased, but used effectively two times.

Furthermore, because the weight of the rotating disc is considerably less, the centrifugal force that is generated by it also decreases, resulting in less stress on the disc and the wear and tear on the rotating disc assembly.

A further advantage of the present invention is that because the rotating disc has cutting surfaces on both sides, the rotating disc can be substantially symmetrical about the radial access. In this way, the rotating disc can be symmetric about the radial plane such that the centre of mass will lay on the axis or rotation. This decreases flexing of the rotating disc in either direction while it is rotating. Furthermore, the stationary disc is also preferably a symmetrical about the radial axis which facilitates the manufacturing process.

A further advantage of the present invention is that there are no cooling liquids such as water used within the reducing machine. In this way, the risk of contamination, as well as rusting, which have occurred with water leaking in the prior art water cooling systems, is avoided. The only components used in the cooling of the stationary disc according to preferred embodiments of the present invention is air, preferably drawn in through the same negative pressure caused by a fan or, in a preferred embodiment, the fan of the reducing machine itself.

A further advantage of the present invention is that the reducing machine can be initially heated to a useable temperature much more quickly. This is the case, at least because the air cooling of the stationary disc is less aggressive and does not interfere with the initial heating of the overall system. Thus, initial heating time can be reduced and the amount of off-spec material produced during the initial heating time can be lessened. Furthermore, the wear and tear on the entire reducing machine, including the rotating and stationary disc, is lessened because less material must be inputted during the initial heating stage.

A further advantage of the invention is that air flow over the stationary disc can be controlled to better manage the temperature of the reducing machine as a whole. This is particularly useful at the initial heating stage where heat is preferably retained in the system.

Further aspects of the invention will become apparent upon reading the following detailed description and drawings, which illustrate the invention and preferred embodiments of the invention.

BRIEF DESCRIPTION OF THE DRAWINGS

In the drawings, which illustrate embodiments of the invention:

FIGS. 5A-5D illustrate the rotating disc according to one embodiment of the present invention;

DETAILED DESCRIPTION OF THE PREFERRED EMBODIMENTS

Preferred embodiments of the invention and its advantages can be understood by referring to the present drawings. In the present drawings, like numerals are used for like and corresponding parts of the accompanying drawings.

Figure 1:
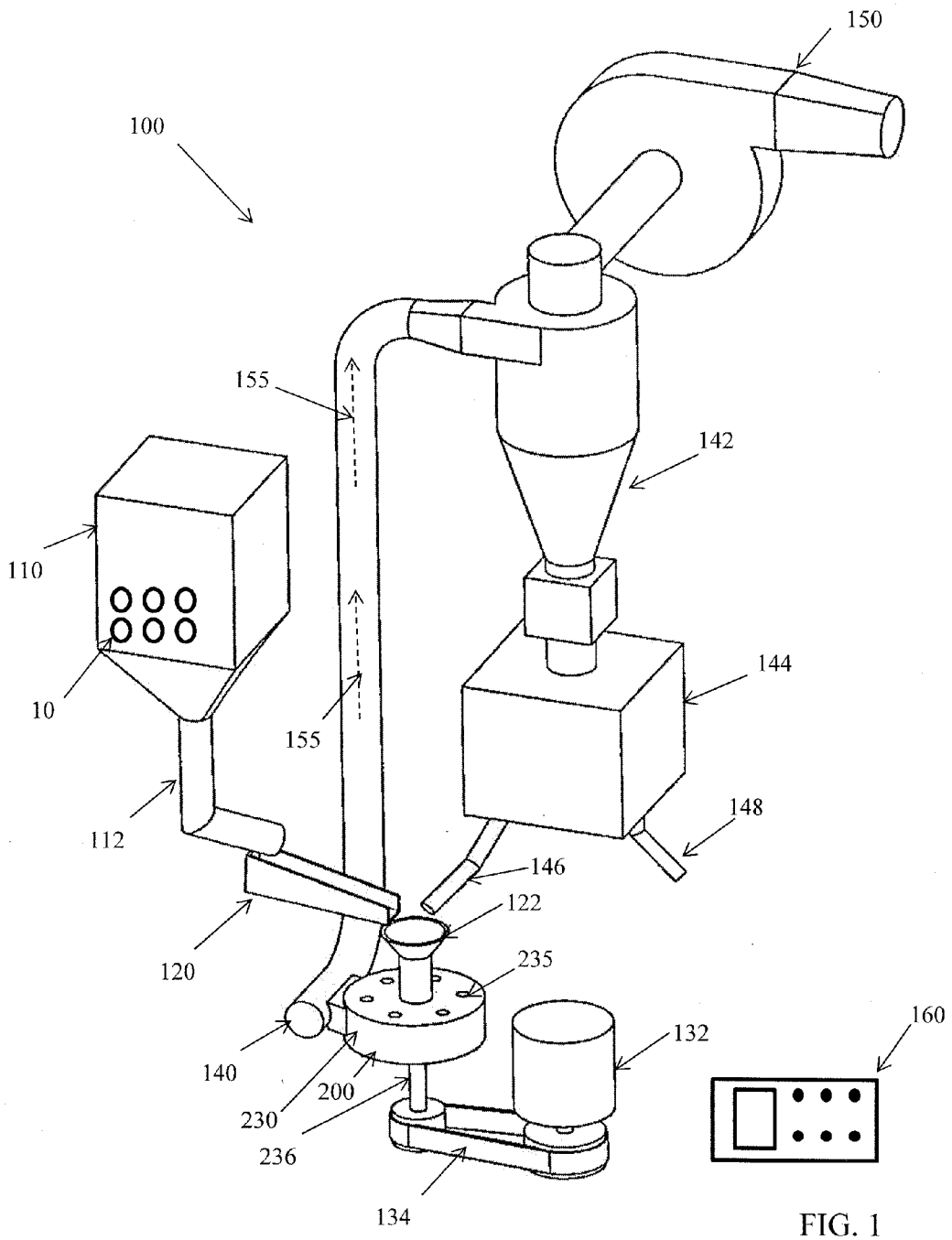
FIG. 1 is a drawing showing an overall reducing machine including the mill assembly according to one embodiment of the present invention.

As shown in FIG. 1, in one embodiment of the present invention, there is provided a reducing machine or system, shown generally by reference numeral 100, for reducing input material shown generally by reference numeral 10. The input material 10 is generally held in a hopper 110, which has an input chute 112 leading to a tray 120 which allows the input material 10 to fall into a funnel 122. The funnel 122 is connected to a mill assembly, as shown generally by reference numeral 200. The mill assembly 200 comprises a mill housing 230 which houses a stationary disc 300 and a rotating disc 500 (not shown in FIG. 1).

The reducing machine 100 also comprises a motor 132 for rotating a rotating shaft 136 (shown in FIG. 2) by means of a pulley 134 or any other type of mechanical connection. The rotating shaft 136 is housed in a rotating shaft housing 236 connected to the rotating disc 500 such that the motor 132, pulley 134 and shaft 136 cause the rotating disc 500 to rotate about the longitudinal axis $L_A$ with respect to the stationary disc 300.

The system 100 comprises a fan 150 which creates a negative air pressure in the duct 140 and causes air to flow along a path shown generally by the dashed arrow and identified generally by reference numeral 155. The reduced material (shown generally by reference numeral 11 in FIG. 2) is generally entrained in the air flow 155 caused by the fan 150 and thereby removed from the mill assembly 200. In one aspect of the present invention, air enters in the mill assembly 200 through air inlets 235 located on the housing lid 232 of the mill housing 230.

The reduced material 11 entrained in the air flow 155 passes through the duct 140, the cyclone 142 into a separator 144. Generally, there is a filter (not shown) from the fan 150 exhaust to prevent reduced material 11 exiting to the environment. The separator 144 will direct the properly reduced material 11 to the "good" material chute 148 where it can be then used as required. Any reduced material 11 that has not been properly reduced is directed through the "oversized" material chute 146 and re-fed into the funnel 122 together with the input material 10 to be processed in the mill assembly 200. A controller, shown generally by reference numeral 160 controls the reducing machine 100 and may comprise sensors, such as temperature sensors (not shown) to sense the temperature of the reducing machine 100 at different locations.

Figure 2:
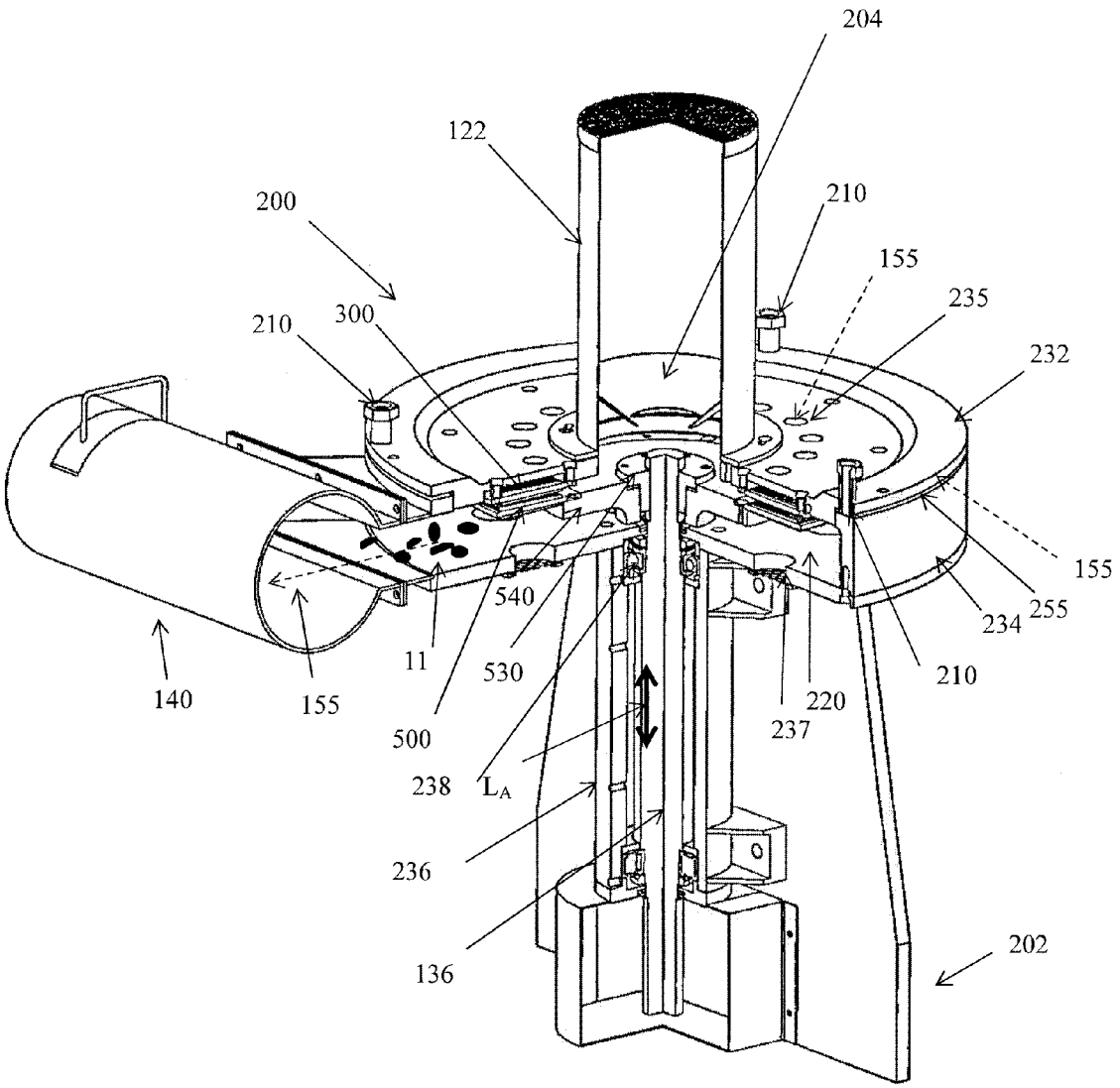
FIG. 2 illustrates a mill assembly with a quarter section removed according to one embodiment of the present invention.

FIG. 2 illustrates the mill assembly 200 in greater detail and with a quarter section cut out. As illustrated in FIG. 2, the duct 140 is connected to the side of the mill assembly 200 and air flow 155 passes through the duct 140 with reduced material 11 entrained therein. The duct 140 is in flow communication with the disc chamber 220 containing the stationary disc 300 and rotating disc 500 and also the air inlets 235 in the housing lid 232 and the lower inlets 237 of the housing body 234. As illustrated in FIG. 2, air from the environment is drawn into the mill assembly 200 through the air inlets 235 in the housing lid 232 as well as the air gap 255 in the housing 230 located between the housing lid 232 and the housing body 234 and the lower air inlets 237 in the housing body 234. The air gap 255, as well as the separation of the housing lid 232 from the housing body 234 may be controlled by the adjusting knobs 210 which also adjusts the separation of the rotating disc 300 and stationary disc 500 to control the size of the reduced material 11 either more coarse or more fine.

As illustrated in FIG. 2, the mill assembly 200 is supported on a mill support 202, which in this embodiment is attached to the rotating shaft housing 236 which houses the rotating shaft 136. The rotating shaft 136 is caused to rotate by means of the rotor 132 and pulley 134 discussed above and illustrated in FIG. 1. The rotating shaft 136 is connected through a bushing 530 and carrying plate 540 to the rotating disc 500 and causes the rotating disc 500 to rotate about the longitudinal axis $L_A$ on bearing block 238.

In operation, raw material 10 enters the mill assembly 200 through the funnel 122, the lower portion of which is illustrated in FIG. 2. As the material to be reduced 10 enters the funnel 122, it passes through the input orifice 204 in the housing lid 230 and stationary disc 300 and then is drawn between the rotating disc 500 and the stationary disc 300 by the negative air pressure caused by the fan 150 and centrifugal force caused by the rotating disc 500. As the material 10 is being reduced by the two discs 300, 500, the reduced material 11 travels radially outwardly from between the two discs 300, 500 and the reduced material 11 becomes entrained in the air flow 155 in the duct 140. As indicated in FIG. 2, the air entering through the air inlets 235 of the housing lid 232 flows into the disc chamber 220 and is permitted to flow between the housing lid 235 and the stationary disc 300 and then out through the duct 140.

FIGS. 3A to 3D illustrate a preferred embodiment of the stationary disc 300. In this preferred embodiment, the stationary disc 300 is symmetrical about the stationary disc radial plane, shown generally by the dashed lines in FIGS. 3A and 3B and identified generally by reference numeral $S_{RP}$. However, it is understood that the invention encompasses other embodiments where the stationary disc 300 is not symmetrical about the stationary disc radial plane $S_{RP}$.

Figure 3A:
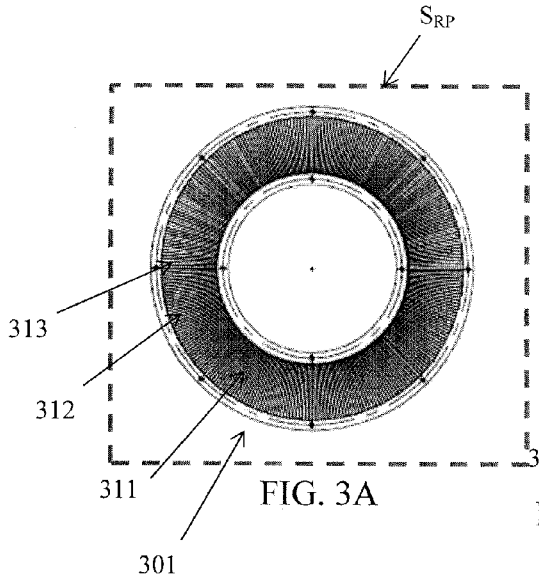
FIGS. 3A-3D illustrate the stationary disc according to one embodiment of the present invention.

FIG. 3A shows the first side 301 of the stationary disc 300, which preferably comprises a first cutting surface 311. The first cutting surface 311 preferably comprises a plurality of substantially radiating extending cutting edges 313. When the stationary cutting surface 311 is in operative interaction with the rotating disc 500, the stationary disc 300 reduces the raw material 10 to the reduced material 11.

Figure 3B:
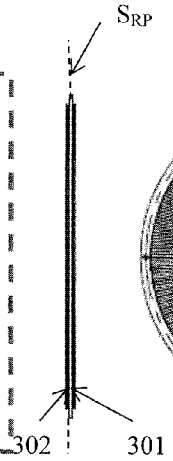
Figure 3C:
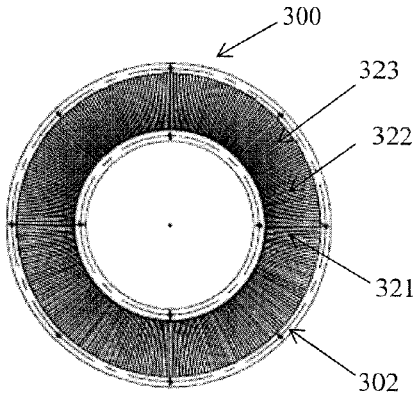
Figure 3D:
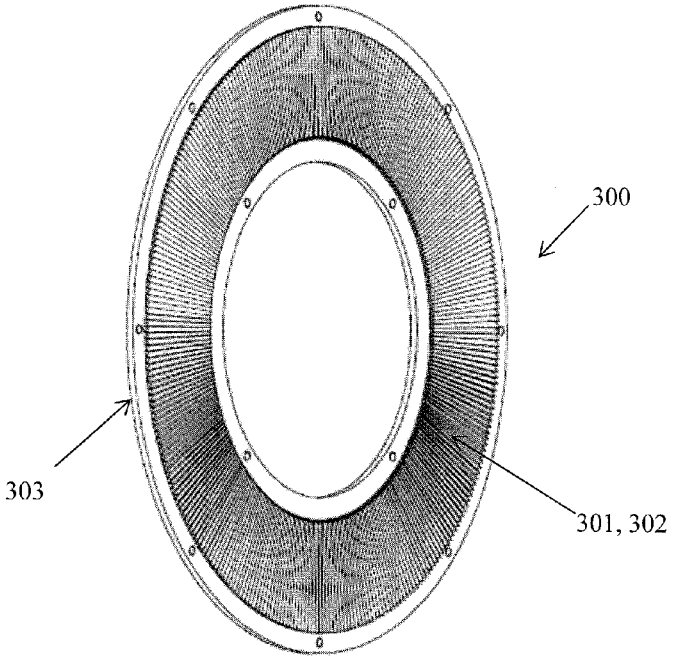

FIG. 3C illustrates the second side 302 of the stationary disc 300 which preferably comprises an air cooling surface 321. The air cooling surface 321 acts as a heat sink, such that when the air cooling surface 321 faces the air inlets 235 of the housing lid 232 and is axially separated therefrom along the longitudinal axis $L_A$ to permit air to flow between the housing lid 232 and the air cooling surface 321 heat is dissipated by the air cooling surface 321. To accomplish this, the air cooling surface 321 preferably has a surface which can facilitate dissipation of heat into the air flow 155. For instance, preferably, the air cooling surface 321 has fins or cooling ridges 323 which preferably extend in a radial direction to permit the air flow 155 to come into contact with a larger surface area, such as in excess of 100%, as compared to a flat surface. In this way, the air cooling surface 321 dissipates heat generated by the stationary disc 300 to the air flow 155.

Accordingly, in one preferred embodiment, the air cooling surface 321 preferably comprises a plurality of radially extending cooling ridges, shown generally by reference numeral 323. This facilitates air cooling of the stationary disc 300 and acts essentially as a heat sink as air flow 155 entering through the air inlets 235 passes between the housing 232 and the air cooling surface 321 to cool the stationary disc 300. Similarly, the cutting surface 311 on the first side 301 has cutting edges 312 which, when the stationary disc 300 is attached to the housing lid 232 in a first orientation, are arranged in facing operative interaction with the rotating cutting surface 511 of the opposed rotating disc 500 to reduce the input material 10.

Preferably, the air cooling surface 321 is in thermal contact with the stationary cutting surface 311. This can be accomplished, for instance, by having a material, generally a metal that is a thermal conductor to conduct heat generated by the cutting surface 311 to the cooling surface 321.

In the preferred embodiment where the stationary disc 300 is substantially symmetrical about the stationary radial plane $S_{RP}$, the plurality of ridges on the air cooling surface 321 also comprises cutting edges 322. In this preferred embodiment, the cutting surface 311 has cutting edges 312, which are themselves oriented on a second plurality of radially extending cooling ridges 313. In this way, the disc 300 can be attached to the housing lid 232 in a second orientation with the first side 301 facing the housing lid 232 and the second side 302 facing the rotating disc 500 to reduce input material 10. In the further preferred embodiment, as illustrated in FIGS. 3A and 3B, where the stationary disc 300 is substantially symmetrical about the radial plane $S_{RP}$, either the first side 301 or the second side 302 can be facing towards the rotating disc 500. Similarly, both the first side 301 and the second side 302 comprise a plurality of ridges 313, 323, which preferably are radially extending in the direction of the air flow 155, such that either plurality of ridges 313, 323 can act as the air cooling surface 321 when they are oriented such as to face the air inlets 235 of the housing lid 232 where air is permitted to flow. Accordingly, in this preferred embodiment, in the second orientation, the plurality of extending ridges of the air cooling surface having cutting edges 322 are arranged in facing operative interaction with the rotating cutting surface of the opposed rotating disc 500 to reduce material 10. Similarly, the plurality of cutting ridges 313 of the cutting surface 311 face the housing lid 232 and the air inlets 235, such that air drawn through the air inlets 235 of the housing lid 232 cross the plurality of cutting ridges of the cutting surface 311 to cool the stationary disc 300 in the second orientation.

Figure 4A:
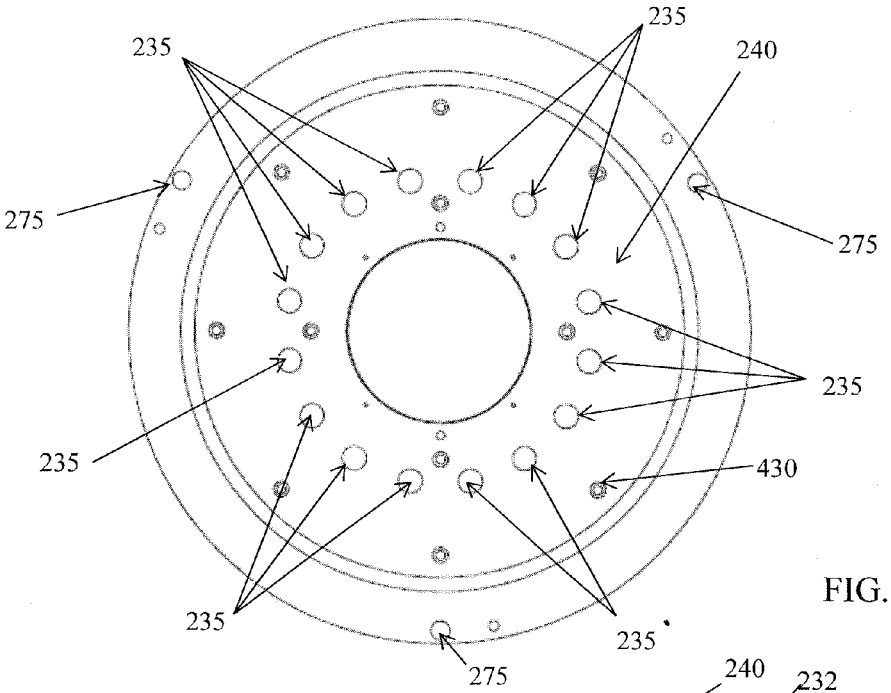
FIGS. 4A, 4B and 4C illustrate the lid of the housing according to one embodiment of the present invention.
Figure 4B:
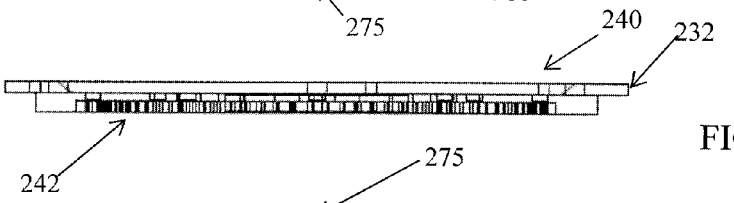
Figure 4C:
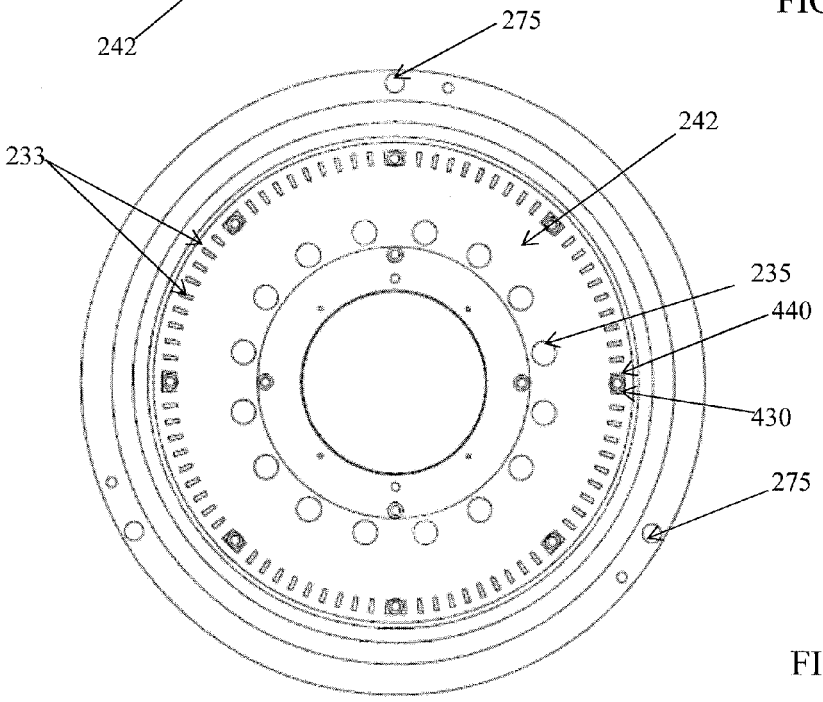

FIGS. 4A, 4B and 4C show the housing lid 232 of the housing 230 for the mill assembly 200 in more detail. As illustrated in FIG. 4A, which shows the external surface 240 of the housing lid 232, the air inlets 235 permit air to flow into the mill housing 230 and specifically between the stationary disc 300 and the inner surface 242 of the housing lid 232 as illustrated in FIG. 4C. The adjustment openings 275 are for the adjusting knobs 210.

As also illustrated in FIG. 4C, and the cross-sectional side view in FIG. 4B, the housing lid 232 preferably comprises support ribs, shown generally by reference numeral 233, that preferably extend from the inner surface 242 of the housing lid 230 axially into the disc chamber 220 a predetermined distance $P_D$ at a radial position along the interior surface 242 of the housing lid 230 corresponding to the radial position of the radial flange 303 of the stationary disc 300 when the stationary disc 300 is attached to the housing lid 232.

Figure 4D:
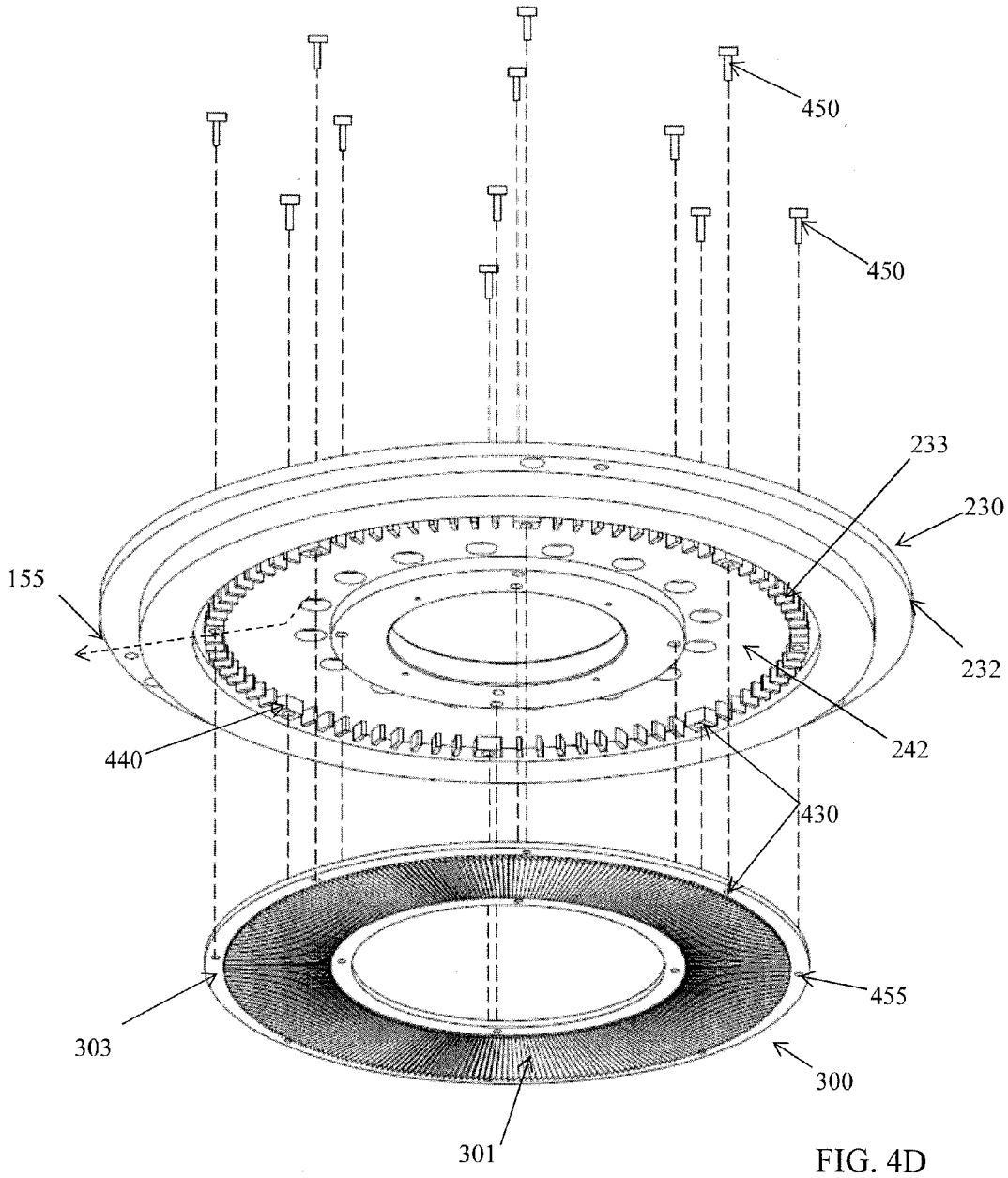
FIGS. 4D and 4E illustrate the stationary disc attaching to the housing lid according to one embodiment of the present invention in an exploded view.

FIG. 4D is an exploded perspective view showing the inner surface 242 of the housing lid 232 having ribs 233 and being attached by an attachment mechanism, shown generally by reference numeral 430, to the stationary disc 300. As illustrated in FIG. 4D, the stationary disc 300 is attached in a first orientation with the first side 301 facing downwards to operatively interact with the rotating cutting surface 511 of the opposed rotating disc 500. The attaching mechanism 430 in this preferred embodiment comprises screws 450 which pass through openings 455 in the radially flange 303 of the stationary disc 300 and engage corresponding openings 441 in the attaching rib 440 located at corresponding radial positions along the inner surface 242 of the housing lid 232.

Figure 4E:
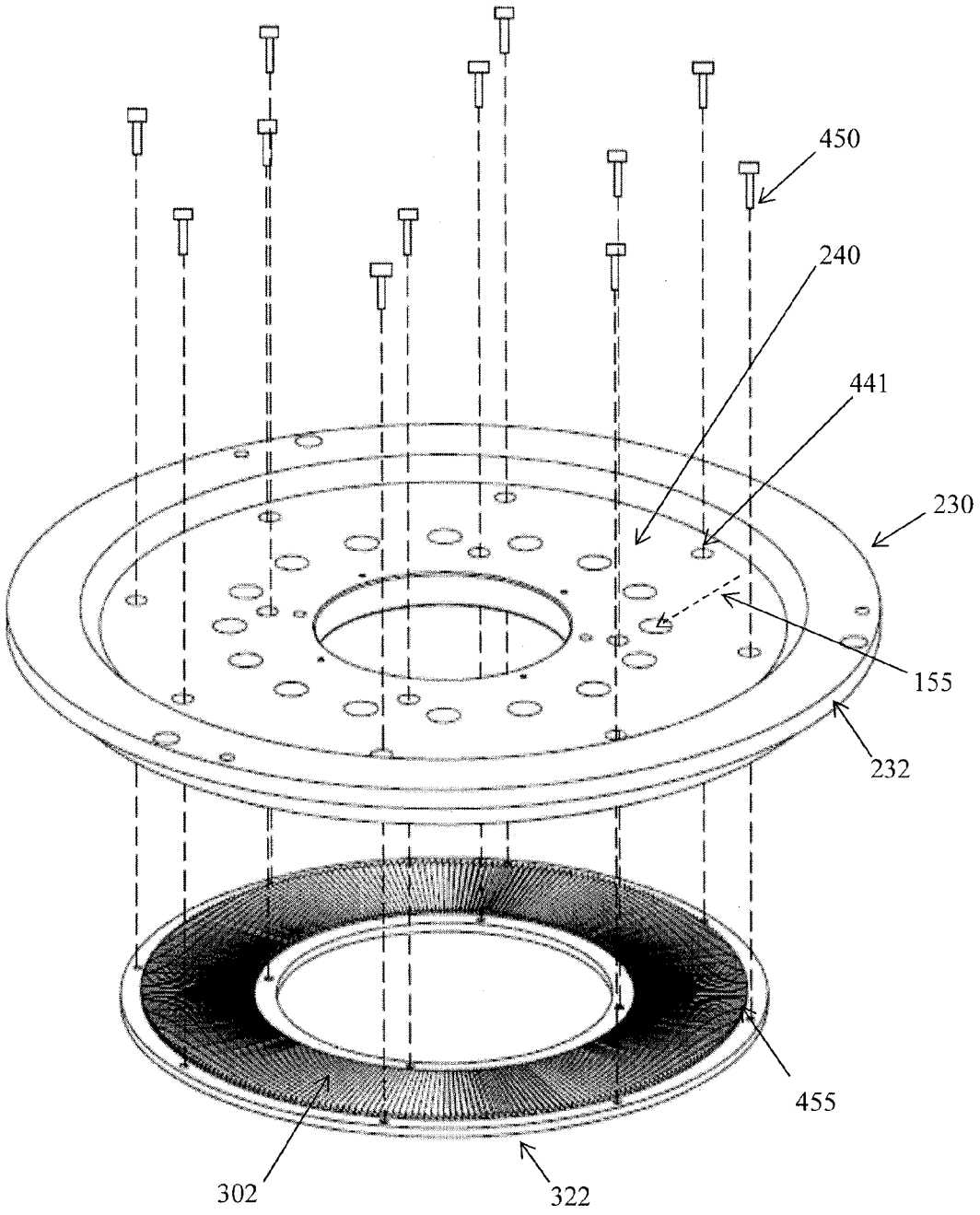

As illustrated in the exploded perspective view of FIG. 4E, in this preferred embodiment the screws 450 pass through the openings 441 in the housing lid 232 through the attaching ribs 440 and engage the corresponding openings 455 in the disc 300. However, it is understood that the attaching mechanism 430 is not limited to such an arrangement of screws 450 and corresponding openings 441, but rather any type of attaching mechanism 430 could be used to operatively attach the stationary disc 300 to the housing lid 232.

In a further preferred embodiment, the attaching ribs 440 extend from the interior surface of the lid housing 232 the same predetermined distance $P_D$ as the supporting ribs 233. In this way, the supporting ribs 233 and the attaching ribs 440 support the stationary disc 300 a predetermined distance from the interior surface 242 of the housing lid 232 to permit the air to flow from the air inlets 235 over the air cooling surface 321, between the gaps 239 of the support ribs 233, and where present between the attaching rib 440 and the support rib 233, to form an air channel 245 from the air inlet 235 to the duct 140.

Figure 4F:
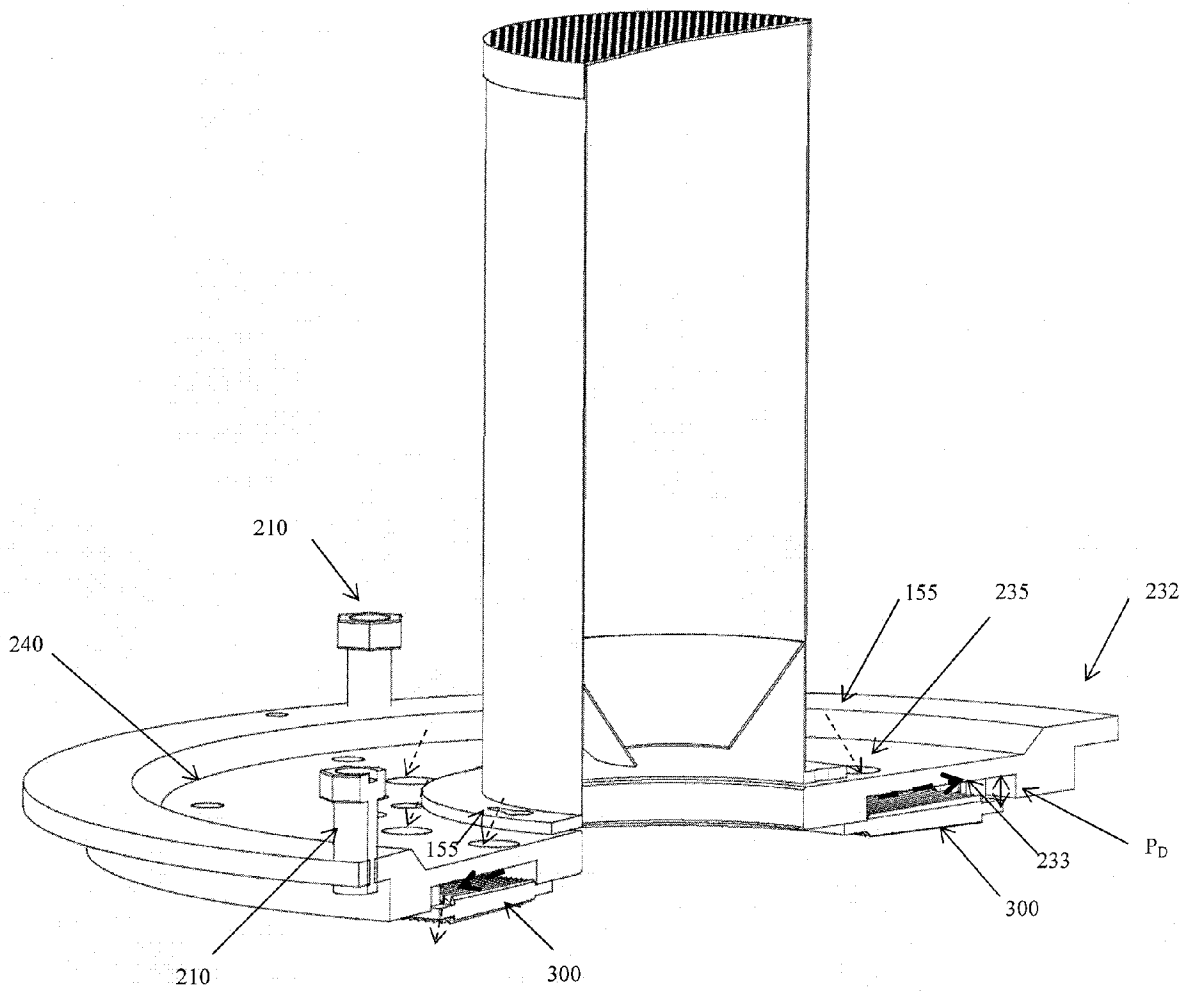
FIG. 4F illustrates the stationary disc attached to the housing lid.
Figure 4G:
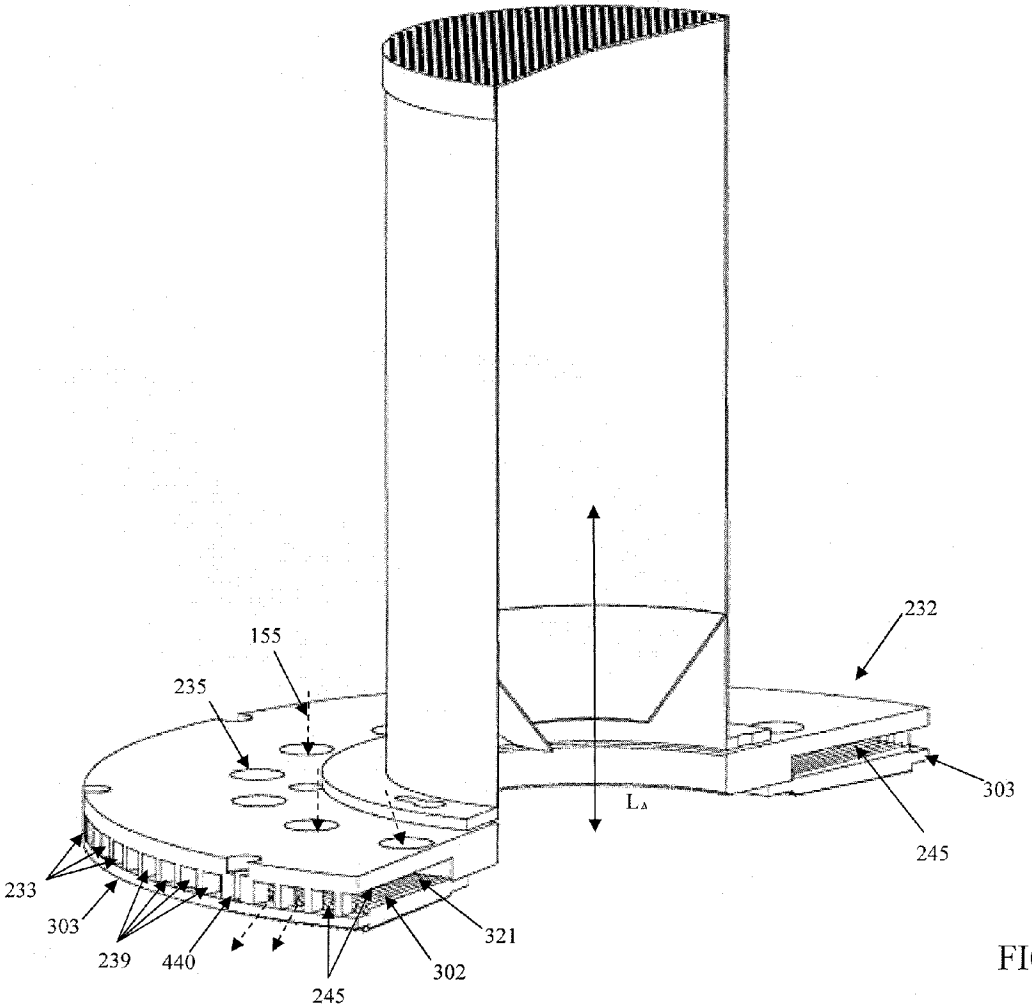
FIG. 4G illustrates the stationary disc attached to the housing lid, but with a portion of the housing lid removed.

FIGS. 4F and 4G show the stationary disc 300 attached to the housing lid 232, with a portion of the housing lid 232 removed in FIG. 4G to better illustrate the air flow 155. As illustrated, in FIGS. 4F and 4G, the radial flange 303 is operatively attached to the attaching ribs 440 which extend axially along the Longitudinal Axis $L_A$ from the inside surface 242 of the housing lid 232 to axially separate the second side 302 of the stationary disc 300 from the inside surface 242 of the housing lid 232 to form the air channel, shown generally by reference numeral 245, from the air inlet 235, across the cooling surface 321, though the gaps 239 between the support ribs 233 and/or attaching ribs 240 and over the flange 303.

Accordingly, the support ribs 233 extend axially inwardly from the inside surface 242 of the housing lid 232 a distance $P_D$ and engage the flange 303 to support the stationary disc 300 against the movement of the rotating disc 500 and the input material 10 and direct air flow 155 from the air inlets 235 through the gaps 239 between the radial flange 303 and supporting ribs 233 (as well as the attaching ribs 440 where present) to form an air channel 245 channeling the air flow 155 over the cooling surface 321.

In a preferred embodiment, where the stationary disc 300 is substantially symmetrical about the radial plane $S_{RP}$'once the cutting edges 313 on the cutting surface 311 are dulled, the stationary disc 300 can be removed from the housing lid 232. In a preferred embodiment, the attaching mechanism 430 operatively releasably attaches the stationary disc 300 to the lid housing 232 in the first orientation with the cutting surface 311 facing the rotating disc 500 and can then re-attach the stationary disc 300 in a second orientation with the cooling surface 321 facing the rotating disc 500. In this preferred embodiment, as indicated above, the cooling surface 321 will have cutting edges 323 on the plurality of cooling ridges 322 such that the cooling surface 321 can act as a second cutting surface 311'. Similarly, the cutting surface 311 will have a plurality of cutting ridges 312 upon which the cutting edges 313 are oriented, such that the cutting surface 311 can also act as a second cooling surface 321. In this way, the longevity of the stationary disc 300 can be effectively doubled. In a further preferred embodiment, the stationary disc 300 has a relatively thin thickness, such that once the cutting edges 313 on the cutting surface 311 and the cutting edges 323 on the cooling surface 321 are dulled, the stationary disc 300 can simply be discarded and a new disc 300 can be operatively attached to the housing lid 232 for continued use in the milling assembly 200.

FIGS. 5A to 5D illustrate the rotating disc 500 according to one preferred embodiment. As with the stationary disc 300, the rotating disc 500 is preferably symmetrical about the central radial plane, which is illustrated in FIGS. 5A and 5B by the dashed line and identified generally by the reference numeral $R_{RP}$ identifying the central radial disc radial plane. However, it is understood that the radial disc 500 may have other orientations and shapes and need not necessarily be symmetrical about the central radial disc radial plane $R_{RP}$.

In a preferred embodiment shown in FIGS. 5A to 5D, the rotating disc 500 has preferably a first side 501 shown in FIG. 5A, and a second side 502, shown in FIG. 5C. The first side 501 preferably has a first cutting surface 511 and the second side, 502, preferably has a second cutting surface 521. In a preferred embodiment, where the rotating disc 500 is substantially symmetrical about the radial disc radial plane $R_{RP}$, it is understood that the first cutting surface 511 will be substantially identical to the second cutting surface 521. As illustrated in FIG. 6, the first and second cutting surfaces 511, 521 of this embodiment have respective radial ridges 512, 522, having sharpened edges 513, 523, respectively. This is shown best in FIG. 6 with the understanding that in this preferred embodiment, the first side 501 is substantially the same as the second side 502.

Figure 6A:
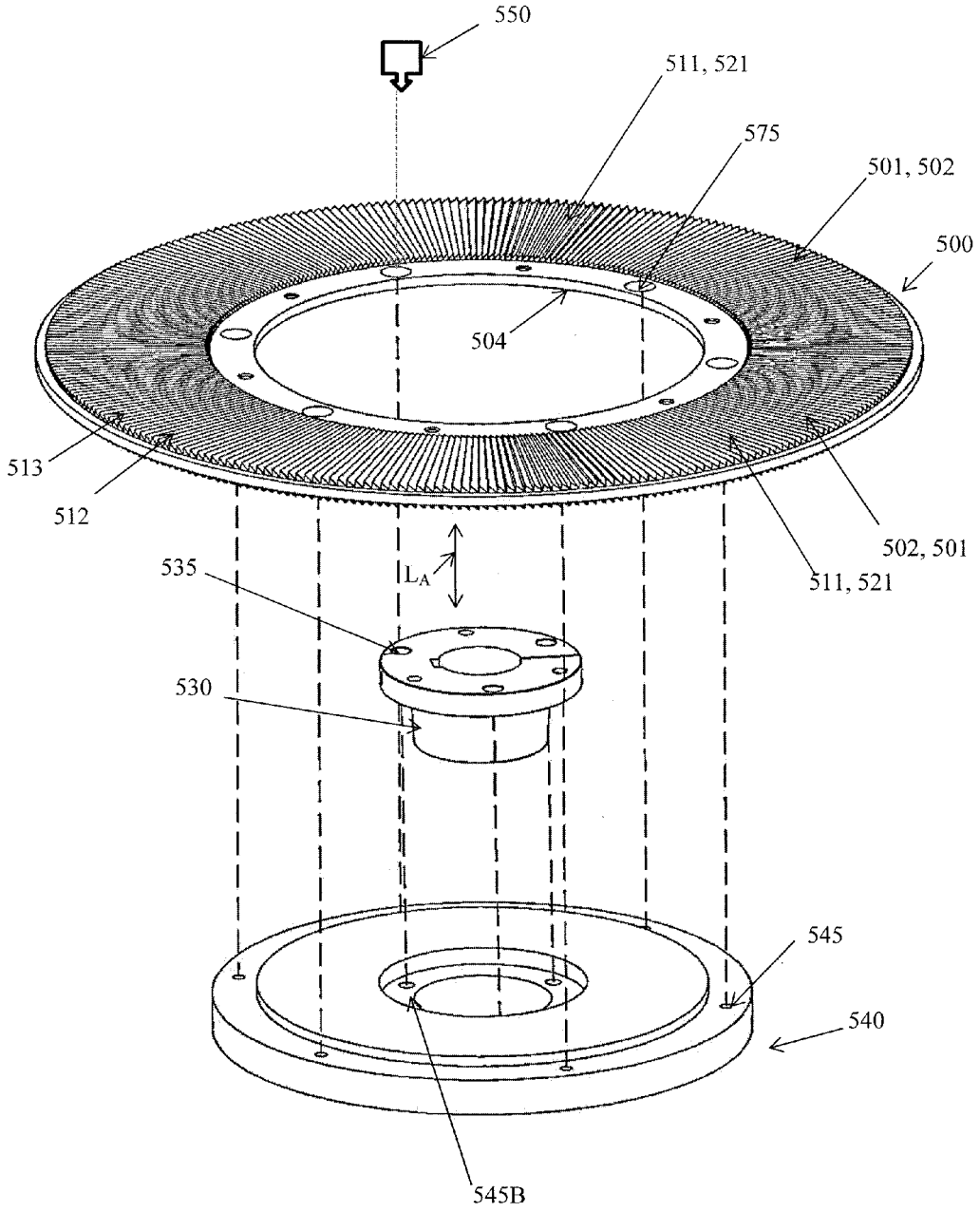
FIG. 6A illustrates the rotating disc attaching to the carrying plate according to one embodiment of the present invention.
Figure 6B:
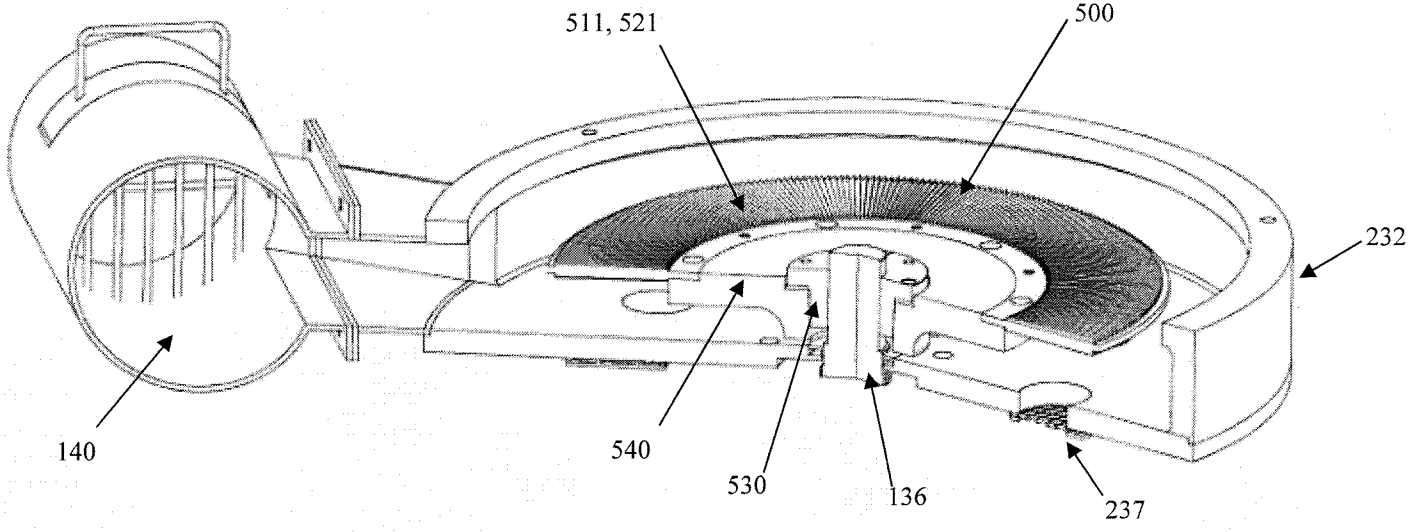
FIG. 6B illustrates the rotating disc in the mill assembly.

As illustrated best in FIGS. 6A and 6B, the rotating disc 500 is connected to the carrying plate 540. This may be accomplished by a number of means including, as illustrated in FIG. 6, having a securing device 550, such as a screw, bolt, etc. going through holes 575 on the inner attaching flange 504 and corresponding holes 545 on the carrying plate 540 to attach the rotating disc 500 to the carrying plate 540.

Furthermore, as also illustrated in FIGS. 6A and 6B, the carrying plate 540 is itself attached to a bushing 530. This can be accomplished through other securing devices going through the holes 535 in the bushing 530 and corresponding holes 545B in the carrying plate 540. The bushing 530 and carrying plate 540 can then be connected to the rotating shaft 136 discussed above. When the rotating disc 500 is attached to the carrying plate 540, the rotating shaft 136 will rotate the rotating disc 500 about the longitudinal axis $L_A$ as shown generally by reference in FIGS. 6A and 6B corresponding to the longitudinal axis $L_A$ shown in FIG. 2.

Similar to the stationary disc 300, the rotating disc 500 can be attached to the carrying plate 540 and then fixed to the rotating shaft 136 in a first orientation, where the first cutting surface 511 is facing the stationary disc 300 to reduce input material 10. This would be the case, for instance, when the first side 501 is facing away from the carrying plate 540. In this first orientation, the first cutting surface 511 can interact with the corresponding cutting surface 311 of the stationary disc 300 to reduce input material 10. Once the first rotating cutting surface 511 is no longer functional for reducing input material 10, such as if the edges 513 have become dull, the rotating disc 500 can be detached from the carrying plate 540 and re-attached in a second orientation, with the second rotating cutting surface 521 facing the stationary disc 300 to reduce input material 10. In this way, the effective useful life of the rotating cutting disc 500 can be doubled. Preferably, the rotating disc 500 and the stationary disc 300 are changed from their respective first orientation to their respective second orientation, at the same time, to minimize maintenance time.

As with the stationary disc 300, in a preferred embodiment, the rotating disc 500 has a relatively thin thickness, such that once the cutting edges 511, 521 are dulled, the rotating disc 500 can be simply discarded. A further advantage of having a relatively thin rotating disc 500 is that the weight of the rotating disc can be reduced decreasing the transportation cost of the rotating disc 500 as well as decreasing the thrust load on the bearing block 238 and the associate wear and tear.

A further advantage of the preferred embodiment, where the rotating disc 500 is substantially symmetrical about the central radial disc radial plane $R_{RP}$, is that the rotating disc 500 will also be substantially symmetrical about the plane of rotation of the rotating disc $P_{RP}$ as shown generally by the symbol $P_{RP}$, and, substantially coincides with the dashed lines of the central radial disc radial plane $R_{RP}$. This facilitates stability of the central rotating disc 500 as it rotates with respect to the stationary disc 300. Also, having the radial disc radial plane $R_{RP}$ substantially coincident with the plane of rotation of the rotating disc $P_{RP}$ when the rotating disc 500 is attached at rotating shaft 136, avoids flexing of the rotating disc 500 due to centrifugal force, which could be caused, for instance, if the radial disc 500 has a centre of mass which deviated from the plane of rotation of the rotating disc 500.

During initial operation, when the reducing machine 100 is cold and not yet warmed up to the optimal operating temperature, reducing material 10 will be inserted into the hopper 110 and reduced in order to initially heat or warm up the reducing machine 100. As indicated above, the fan 150 will draw air through the air inlets 235 and across the air cooling surface 321 of the stationary disc 300. As the air passes between the housing lid 232 and the air cooling surface 321, the air will absorb heat from the air cooling surface 321 that is generated from the cutting surface 311 of the stationary disc 300. This warmed air will then travel through the ducts 140 with the entrained reduced material 11 and facilitate warming the reducing machine 100 so that it may more quickly reach the optimal operating temperature to properly process input material 10. In this way, the air cooling surface 321 facilitates the initial warming of the reducing machine 100 thereby lessening the warm up time, the off-spec material prior to the system 100 reaching the optimal operating temperature and the corresponding wear and tear on the discs 300, 500. It is understood that in the preferred embodiment where the stationary disc 300 is substantially symmetrical about the stationary disc radial plane $S_{RP}$, the same effect will arise if the stationary disc 300 is in the second orientation with the cutting surface 311 facing the air inlets 235 of the housing lid 232 and acting as the second air cooling surface 321'.

As described above, in a preferred embodiment, the stationary disc 300, rotating disc 500 and mill assembly 200 are used in a reducing machine or system 100 which is preferably a pulverizing apparatus to reduce the input material 10 to essentially powder. It is understood, however, that the stationary disc 300, rotating disc 500 and milling machine 200 could be used in other types of reducing machines or systems 100 and are not necessarily restricted to pulverizing machines. It is also understood that in one embodiment, the air inlets 235 could be periodically closed or obstructed intentionally. This can be the case, for instance, to control the temperature of the mill assembly 200 and the reducing machine 100 as a whole. For instance, at the initial start up, one or more of the air inlets 235 could be blocked in order to decrease the air passing over the air cooling surface 321 of the stationary disc 300 to facilitate initial heating of the reducing machine 100.

Figure 7A:
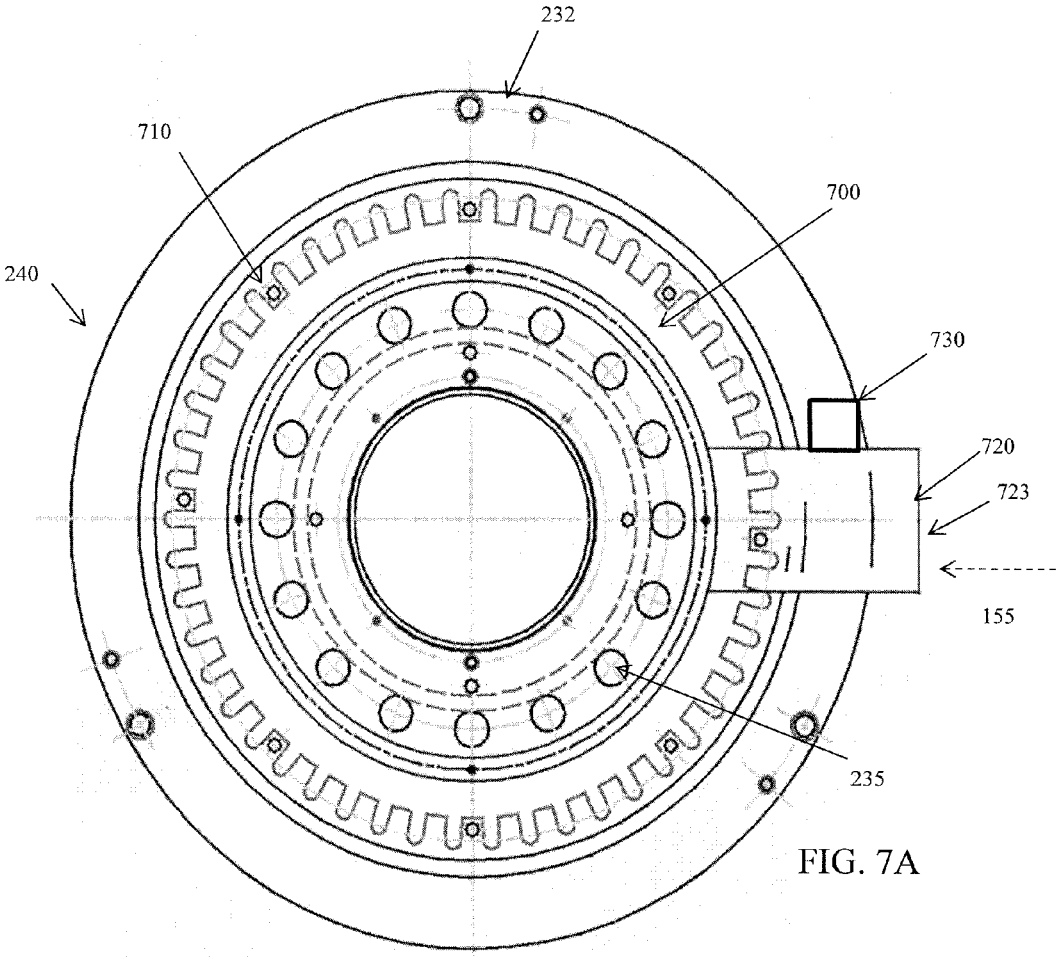
FIG. 7A illustrates a top view of an air restricting device attached to the housing lid according to one preferred embodiment of the present invention.
Figure 7B:
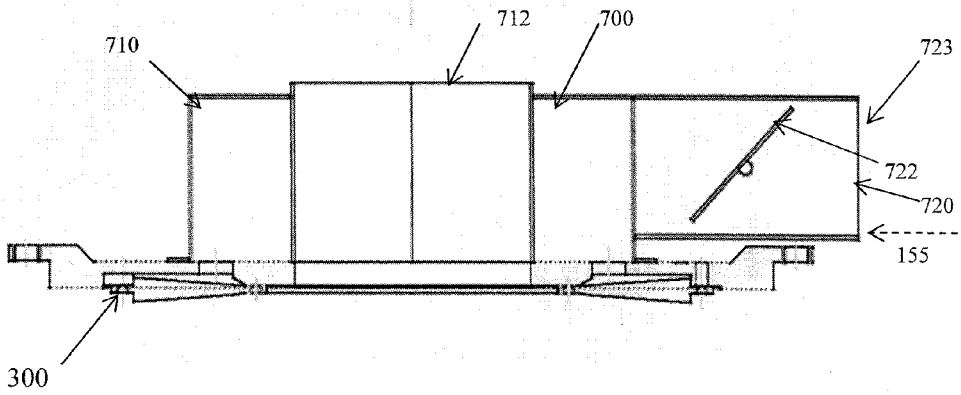
FIG. 7B illustrates the side view of the air restricting device shown in FIG. 7A.

In a further preferred embodiment, as illustrated in FIGS. 7A and 7B, the present invention provides an air restricting device, shown generally by reference numeral 700. The air restricting device 700 preferably rests upon, or is attached to, the external surface 240 of the housing lid 232. For ease of illustration, the air inlets 235 are shown in dashed lines. This reflects that the air restricting device 700 rests on top of the air inlets 235 to guide air into the air inlets 235 from the environment.

Preferably, the air restricting device 700 comprises an air baffle as shown generally by reference numeral 710, which has a central orifice 712, which is coincident with the input orifice 204 to permit input material 10 to enter the mill assembly 200.

The air baffle 710 is in fluid communication with an air damper, as shown generally by reference numeral 720. The air damper 720 has a flange 722 or other type of air restricting member which has an open position, permitting air flow through the damper opening 723 of the damper 720, and a closed position restricting air flow through the damper opening 723 of the damper 720. Preferably, the air restricting device 700 comprises a mechanical control, such as a solenoid or stepper motor as shown generally by reference numeral 730, to control movement of the flange 722 from the open position to the closed or restricted position. In a preferred embodiment, the mechanical motor 730 can adjust the position of the flange 722 at a plurality of different angles to more precisely control the air flow 155 through the damper 720 and therefore through the air inlets 235.

In operation, when it is desired to raise the temperature of the reducing machine 100, the damper 720 is moved to the closed or restricted position to restrict the air flow 155 through the damper 720, the air baffle 710 and the air inlets 235. In this way, the air cooling effect of the air cooling surface 321 on the stationary disc 300 is limited as the air flow 155 across the air cooling surface 321 is decreased thereby preventing the dissipation of heat through convection across the plurality of radially extending cooling ridges 323. When the reducing machine 100 is at a desired temperature and further heating is not required, the damper 720 is moved to the open position permitting air flow 155 through the damper opening 723, through the air baffle 710 to the air inlets 235 and across air cooling surface 321 thereby facilitating cooling of the stationary disc 300. It is understood that because air is a less aggressive form of cooling compared to water or other liquids which have a higher heat capacity, opening the air damper 720 when the reducing machine 100 and, in particular, the stationary disc 300 is at an optimal temperature, will not damage or adversely affect the stationary disc 300.

In a further preferred embodiment, during initial start up, the air restricting device 700 restricts the flow of air through the air inlet 235. This can be accomplished in the preferred embodiment by moving the flange 722 to the closed position restricting air flow 155 through the damper 720. In this way, as input material 10 is passed through the reducing machine 100 during initial start up, the heat generated by the disc mill assembly 200 will be retained within the reducing machine 100 in order to facilitate initial heating at start up. Once the initial heating of the reducing machine 100 is completed and the reducing machine 100 is at the operating temperature, the air control device 700 will permit air flow 155 through the air inlets 235 to cool the stationary disc 300. Because the heat capacity of air is not as high as liquids, such as water, the stationary disc will not experience thermal shock when the air restricting device 700 permits air flow 155 through the air inlets 235 even if the stationary disc 300 and reducing machine 100 are at the operating temperature. In this way, preheating at initial start up, as well as the generation of off spec material and the corresponding wear and tear on the reducing machine 100, can be reduced. In a preferred embodiment the controller 160 will comprise temperature sensors (not shown) to sense the temperature of the reducing machine 100 at different locations. The controller 160 may then also automatically control the air restricting device 700 to permit air flow 155 through the air inlets 235 when initial heating of the reducing machine 100 is completed. For instance, the controller 160 may send a signal to the motor 730 to move the flange 722 permitting air flow through the damper 720 as the temperature of the reducing machine 100 approaches the optimal operating temperature.

It is understood that the radial flange 303 of the stationary disc 300 is shown as being substantially circumferential in extending radially a constant length along the entire stationary disc 300 from the cutting surface 311 and air cooling surface 321. It is understood, however, that the radial flange 303 can have any other type of shape and it needs not be restricted to circular. For instance, the radial flange 303 could have individual projections to engage the housing lid 232 in order to permit the attaching mechanism 430 to releasably attach a stationary disc 300 to the housing lid 232. For instance, the radial flange 303 could consist of a plurality of individual radial protrusions which engage the bosses 440. It is preferred, however, to have the radial flange 303 may extend radially along most of the circumference of the stationary disc 300 so that the stationary disc 300 can be supported by the ribs 233 on the inner surface 242 of the housing lid 232.

It is also understood that the housing lid 232 is part of the housing 230 to house the mill assembly 200. As indicated above, reference to housing lid 232 is understood to be a portion of the overall housing 200 and therefore it could be referred to as the housing 230 of the mill assembly 200. Also, the portion of the housing 230 to which the stationary disc 300 is attached, need not necessarily be the top portion, but rather the housing lid 232 may be any portion of the housing 230 to which the stationary disc 300 is attached.

To the extent that a patentee may act as its own lexicographer under applicable law, it is hereby further directed that all words appearing in the claims section, except for the above defined words, shall take on their ordinary, plain and accustomed meanings (as generally evidenced, inter alia, by dictionaries and/or technical lexicons), and shall not be considered to be specially defined in this specification. Notwithstanding this limitation on the inference of "special definitions," the specification may be used to evidence the appropriate, ordinary, plain and accustomed meanings (as generally evidenced, inter alia, by dictionaries and/or technical lexicons), in the situation where a word or term used in the claims has more than one pre-established meaning and the specification is helpful in choosing between the alternatives.

It will be understood that, although various features of the invention have been described with respect to one or another of the embodiments of the invention, the various features and embodiments of the invention may be combined or used in conjunction with other features and embodiments of the invention as described and illustrated herein.

Although this disclosure has described and illustrated certain preferred embodiments of the invention, it is to be understood that the invention is not restricted to these particular embodiments. Rather, the invention includes all embodiments, which are functional, electrical or mechanical equivalents of the specific embodiments and features that have been described and illustrated herein.

The embodiments of the invention in which an exclusive property or privilege is claimed are defined as follows:

1. A disc mill assembly of a reducing apparatus having a fan, said disc mill assembly comprising:

a rotating disc having a rotating cutting surface;

a stationary disc having a stationary cutting surface on a first side for operative interaction with the rotating cutting surface of the opposed rotating disc, and, a second side having an air cooling surface in thermal contact with the stationary cutting surface;

a housing lid having air inlets on an external wall;

an attaching mechanism for operatively attaching the stationary disc to the housing lid with the air cooling surface facing the air inlets and axially separated therefrom to permit air flow between said housing and the cooling surface;

wherein, during operation, the fan draws air from the air inlets, between the housing and the air cooling surface to cool the stationary disc; and wherein the attaching mechanism comprises a radial flange located intermediate the air cooling surface and cutting surface, said radial flange operatively attaching to at least one attaching rib extending axially from an inside surface of the external wall of the housing lid to axially separate the second side of the disc from the inside surface of the housing lid and form an air channel from the air inlets across the cooling surface and over the radial flange.

2. The disc mill assembly as defined in claim 1 wherein, during operation, reduced material from the stationary disc and rotating disc becomes entrained in air flow from the air inlets.

3. The disc mill assembly as defined in claim 1 wherein the housing comprises support ribs extending axially inwardly from the inside surface of the housing lid and engaging the radial flange of the stationary disc when said disc is attached to the at least one attaching rib, said support ribs supporting the stationary disc and directing air flow from the air inlet through gaps formed between the radial flange and the supporting ribs.

4. The disc mill assembly as recited in claim 1 wherein the air cooling surface comprises a plurality of substantially radially extending cooling ridges having cutting edges and the stationary cutting surface comprising a plurality of substantially radially extending cutting ridges having cutting edges;

wherein the attaching mechanism operatively attaches the stationary disc to the housing in a first orientation, with the air cooling surface facing the air inlets and axially separated therefrom to permit air to flow between said housing lid and said cooling surface, and, with said plurality of substantially radially extending cutting ridges of the stationary cutting surface arranged in facing operative interaction with the rotating cutting surface of the opposed rotating disc to reduce the input material, and wherein the attaching mechanism operatively attaches the stationary disc to the housing lid in a second orientation, with said plurality of substantially radially extending cutting ridges of the stationary cutting surface facing the air inlets and axially separated there from to permit air to flow between said housing lid and said cutting surface, and, with said plurality of cooling ridges of the air cooling surface having cutting edges arranged in facing operative interaction with the rotating cutting surface of the opposed rotating disc to reduce the input material, and wherein, in the second orientation, during operation, air is drawn through the air inlets of the housing and across the plurality of cutting ridges of the cutting surface to cool the stationary disc.

5. The disc mill assembly as defined in claim 1 wherein, the rotating disc is substantially symmetrical about a central radial plane and said rotating disc comprises a second rotating cutting surface substantially opposite to the rotating cutting surface about the central radial plane; and wherein the rotating disc is fixed to a rotating shaft in a first orientation with respect to the stationary disc with the rotating cutting surface facing the stationary disc to reduce input material, and after the rotating cutting surface is no longer functional for reducing input material, the rotating disc is fixed to the rotating shaft in a second orientation with respect to the stationary disc with the second rotating cutting surface facing the stationary disc to reduce input material.

6. The disc mill assembly as defined in claim 5 wherein the central radial plane substantially coincides with a plane of rotation of the rotating disc.

7. The disc mill assembly as defined in claim 1 further comprising:

an air control device for controlling air flow through the air inlets; and wherein the air control device restricts air flow through the air inlets to retain heat generated by the disc mill assembly within the reducing machine.

8. The disc assembly as defined in claim 7 wherein the air control device comprises an air damper having an open position permitting air flow therethrough and a closed position restricting air flow therethrough; and an air baffle for directing air flow from the air damper to the air inlets.

9. The disc assembly as defined in claim 7 wherein during initial start up of the reducing machine, the air control device restricts air flow through the air inlets to facilitate initial heating of the reducing machine.

10. The disc assembly as defined in claim 9 wherein once the initial heating of the reducing machine is completed, the air control device permits air flow through the air inlets to cool the stationary disc.

* * * * *